United States Patent [19]

Coone

[11] Patent Number: 4,892,144

[45] Date of Patent: Jan. 9, 1990

[54] INFLATABLE TOOLS

[75] Inventor: Malcolm G. Coone, Katy, Tex.

[73] Assignee: Davis-Lynch, Inc., Pearland, Tex.

[21] Appl. No.: 301,862

[22] Filed: Jan. 26, 1989

[51] Int. Cl.[4] ..... E21B 33/127; E21B 33/129

[52] U.S. Cl. ..... 166/122; 166/134; 166/187; 277/34

[58] Field of Search ..... 166/118, 120, 122, 134, 166/179, 187, 203, 206, 207, 212; 277/34, 34.3, 34.6; 285/97, 100, 106, 107, 109, 294, 297

[56] References Cited

U.S. PATENT DOCUMENTS

| | | | |
|---|---|---|---|
| 2,643,722 | 6/1953 | Lynes et al. | 166/10 |
| 2,778,432 | 1/1957 | Allen | 166/187 |
| 3,364,997 | 1/1968 | Current | 166/134 |
| 3,529,667 | 9/1970 | Malone | 166/187 |
| 3,581,816 | 6/1971 | Malone | 166/187 |
| 3,604,732 | 9/1971 | Malone | 166/187 |
| 3,606,924 | 9/1971 | Malone | 166/187 |
| 3,837,947 | 9/1974 | Malone | 277/34 |
| 3,899,631 | 8/1975 | Clark | 166/187 |
| 4,052,861 | 10/1977 | Malone et al. | 61/86 |
| 4,063,427 | 12/1977 | Hoffman | 166/187 |
| 4,349,204 | 9/1982 | Malone | 166/187 |
| 4,544,165 | 10/1985 | Coone | 277/34 |
| 4,768,590 | 9/1988 | Sanford et al. | 166/187 |

*Primary Examiner*—Bruce M. Kisliuk
*Attorney, Agent, or Firm*—Vaden, Eickenroht, Thompson & Boulware

[57] ABSTRACT

There are disclosed several embodiments of an inflatable tool of the type comprising a mandrel adapted to be raised and lowered within a well bore and an inflatable element including a sleeve of elastomeric material surrounding a tubular section of the mandrel and anchored at its ends to upper and lower heads which are disposed about the tubular section and relatively movable longitudinally toward and away from one another, upon inflation of the sleeve, as well as substantially flat reinforcing strips of sheet metal or other relatively rigid but flexible material which are arranged about the sleeve with their side edges in overlapping relation and with their ends anchored to the heads so that the strips flex outwardly with the sleeve to cause the inflatable element to engage a wall of the well bore.

27 Claims, 6 Drawing Sheets

FIG. 3
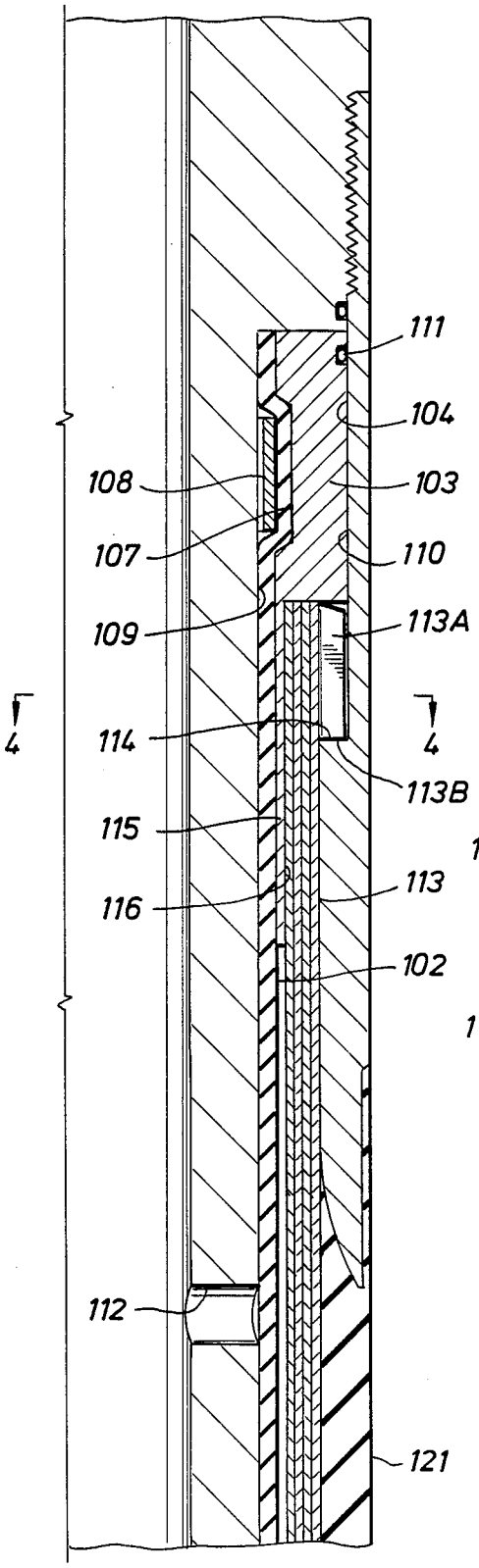
FIG. 4
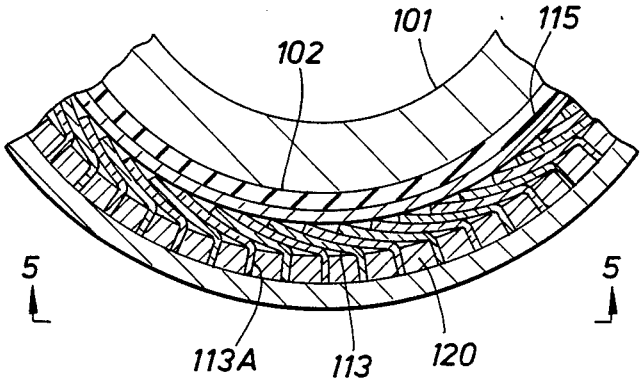
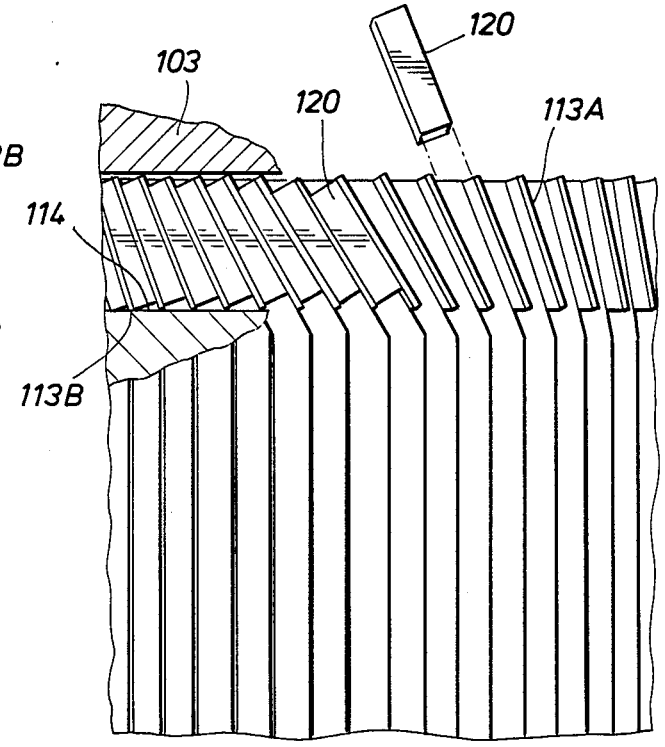
FIG. 5

INFLATABLE TOOLS

This invention relates generally to inflatable tools of the type comprising a mandrel adapted to be arranged concentrically of a cylindrical wall such as a well bore or other conduit and an inflatable element including a sleeve of elastomeric material arranged concentrically of a tubular section of the mandrel and anchored at its ends to upper and lower heads disposed about the tubular section and relatively movable longitudinally toward and away from one another so that, upon inflation of the sleeve, the element is flexed radially into engagement with the wall. More particularly, it relates to improvements in tools of this type wherein the inflatable element is reinforced by substantially flat strips of spring steel or other relatively rigid but flexible material which are arranged concentrically of the side of the sleeve opposite the tubular section of the mandrel and with their side edges in overlapping relation and their ends anchored to the heads so that the strips flex radially with the sleeve to cause the inflatable element to engage the wall.

In one of its aspects, this invention relates to such a tool in which at least a portion of the strips are covered by another sleeve of elastomeric material which is on the side of the strips opposite the first mentioned sleeve and which expands with the strips to sealably engage or pack off the wall, as in the case, for example, of a well packer within a well bore. In another of its aspects, it relates to a tool of this type such as, for example, a packer which, upon inflation to sealably engage the wall, also grips the wall so as to anchor the tool and thus prevent its movement vertically and/or rotationally with respect to the well bore or other wall.

U.S. Pat. Nos. 3,581,816 and 3,604,732 show tools of this type wherein the ends of the reinforcing strips are anchored to the heads of the mandrel by means of adhesive or weldments. U.S. Pat. No. 3,837,947 shows a similar tool in which the ends of the strips are bonded to anchor plates inserted between them. In any case, the reinforcement is difficult and expensive to replace or repair when, for example, the tool is retrieved from the conduit or well bore for reuse.

U.S. Pat. No 4,544,165 shows a well packer of this general type in which the ends of the reinforcing strips are anchored to the mandrel heads by bent portions or offsets held between oppositely facing, conically shaped wedge surfaces in the head. Although this permits replacement or repair of the strips without the problems above noted, large forces acting across the packer may nevertheless pull the bent portions of the strips from between the wedge surfaces, thus rendering the packer unable to hold rated pressures across it.

U.S. Pat. No. 4,349,204 also shows a well packer of this type wherein only a portion or portions of the reinforcing strips are surrounded by an outer sleeve of elastomeric material. Thus, the uncovered portion or portions of the strips are expanded outwardly against the wall adjacent the outer sleeve and back up one side of the sleeve to resist its extrusion due to high pressure on it other side. However, the frictional engagement of the strips with the wall is unable to anchor the packer to the wall in the event of high pressures across it or otherwise prevent vertical and/or rotational movement of the packer.

Conventionally, well packers and other tools of this type are so anchored by slips which are caused to slide over conical surfaces or buttons which are caused to move radially outwardly into engagement with a wall of the well bore and having teeth or other means on their outer sides for biting into the wall when so moved. In either case, however, the anchoring elements and the means by which they are caused to move outwardly to grip the wall are space consuming and of expensive construction.

An object of this invention is to provide an inflatable tool of this type having reinforcing strips whose ends are anchored to mandrel heads in such a manner as to permit them to be repaired and/or replaced with relative ease, but nevertheless with the assurance that they will not be pulled free.

Another object is to provide a tool of this type, and preferably a well packer, which is anchored to the wall automatically in response to expansion of the inflatable element and without the need for slips, buttons or other expensive and space consuming parts.

These and other objects are accomplished, in accordance with one or more of the illustrated embodiments of the present invention, by an inflatable tool of the type described wherein the opposite ends of the reinforcing strips are anchored to the heads by means in each head having inner and outer walls confining the radially inner and outer side edges of the strip and a shoulder facing away from the shoulder in the other head, a portion which extends from one side of each end of each strip to dispose its inner end edge over the shoulder and which is inclined at an acute angle with respect to the longitudinal and extends in a direction from its one side edge toward its other side edge, and spacers between the bent portions of adjacent strips.

In accordance with another illustrated embodiment of the invention, these and other objects are accomplished by an inflatable tool of the type described wherein the opposite ends of the reinforcing strips are anchored to the heads by means in each head having inner and outer walls confining the inner and outer side edges of the strips and a groove about one wall having a shoulder therein which faces away from the shoulder about one wall of the other head, and a tab on each end of each strip which projects from the side thereof in a direction away from its end, each side tab being flexible inwardly to permit it to move over said one wall and opposite the groove and then spring outwardly into the groove to dispose its free end opposite the shoulder.

In certain of their embodiments, each of the inflatable tools is a packer in which at least a portion of the strips intermediate the heads is covered by an outer sleeve of elastomeric material for sealably engaging at least a portion of the wall when forced outwardly thereagainst. In accordance with certain embodiments of the invention, portions of at least certain of the strips which are not covered by the outer sleeve have means on their outer sides for biting engagement with the wall so as to anchor the packer with respect thereto.

In accordance with still another embodiment of the invention, the inflatable tool is a well anchor having the above described means thereabout for biting engagement with the well bore and adapted for connection to a packer or other tool for anchoring it in the well bore.

In any case, it is contemplated that, in accordance with the broader aspects of the invention, the tool may be disposed within a surrounding wall so that the inflatable element is radially outwardly thereagainst, or in surrounding relation to an inner wall so that the element is expanded radially inwardly thereagainst.

In the drawings, wherein like reference characters are used throughout to designate like parts:

FIG. 3 is an enlarged, half-sectional view of the upper end of the packer shown in FIG. 1;

FIG. 4 is a cross-sectional view of the upper end of the packer shown in FIG. 3, as seen along broken lines 4—4 thereof;

FIG. 5 is a side view of the packer, as seen along broken lines 5—5 of FIG. 4, and with a portion of the outer confining wall of the head removed;

Figure 7:
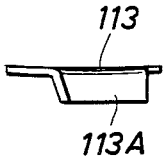
Figure 6:
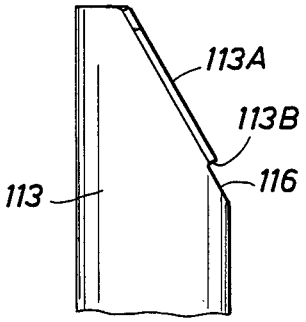
Figure 8:
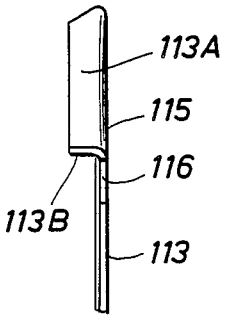
Figure 9:
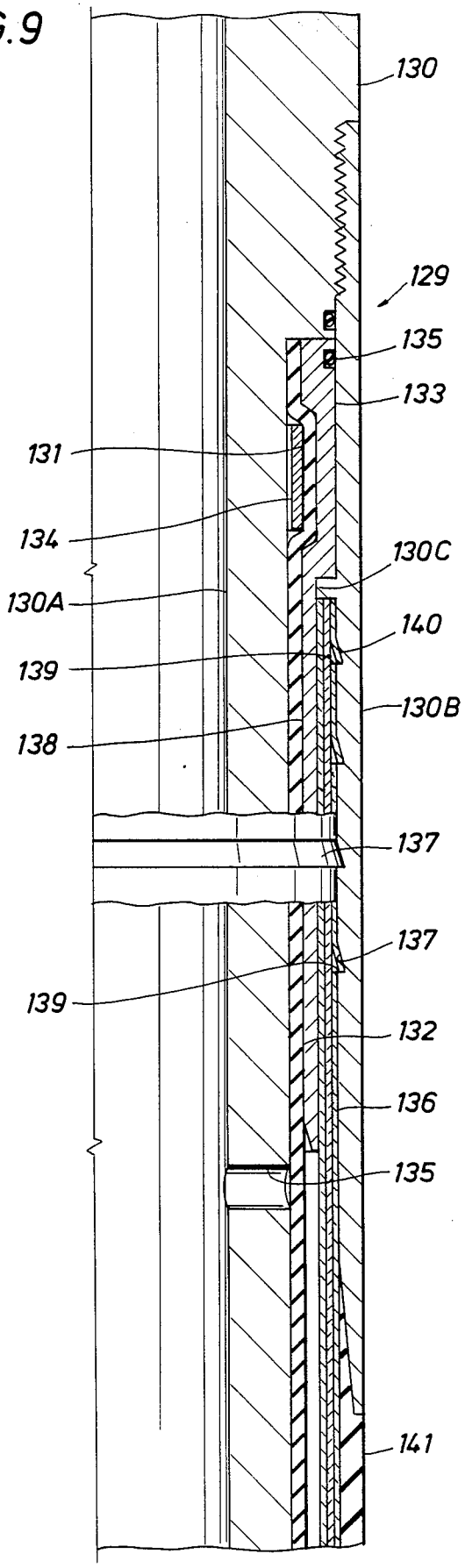
Figure 10:
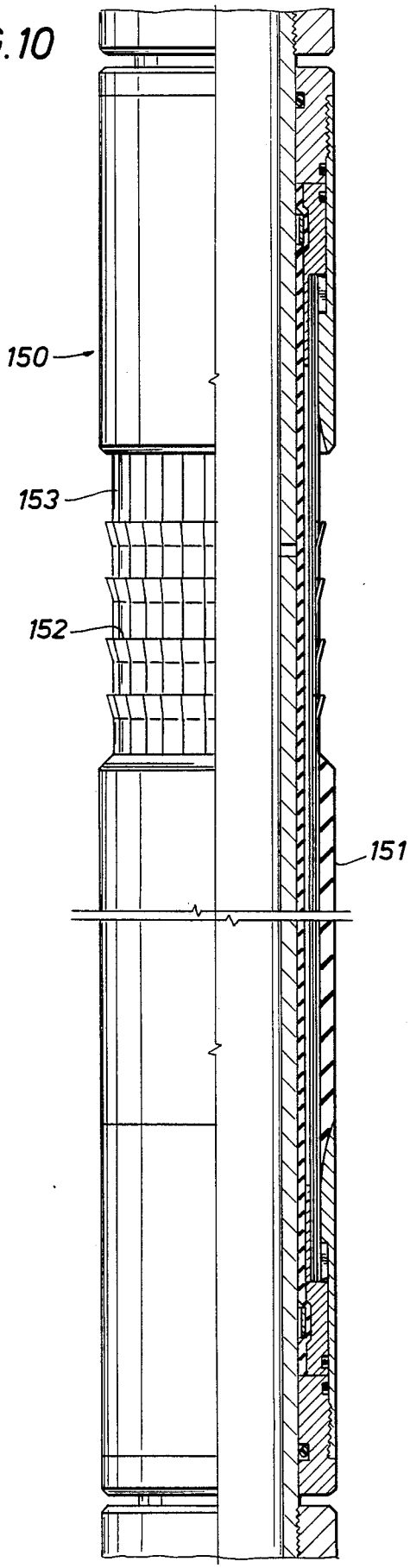
Figure 11:
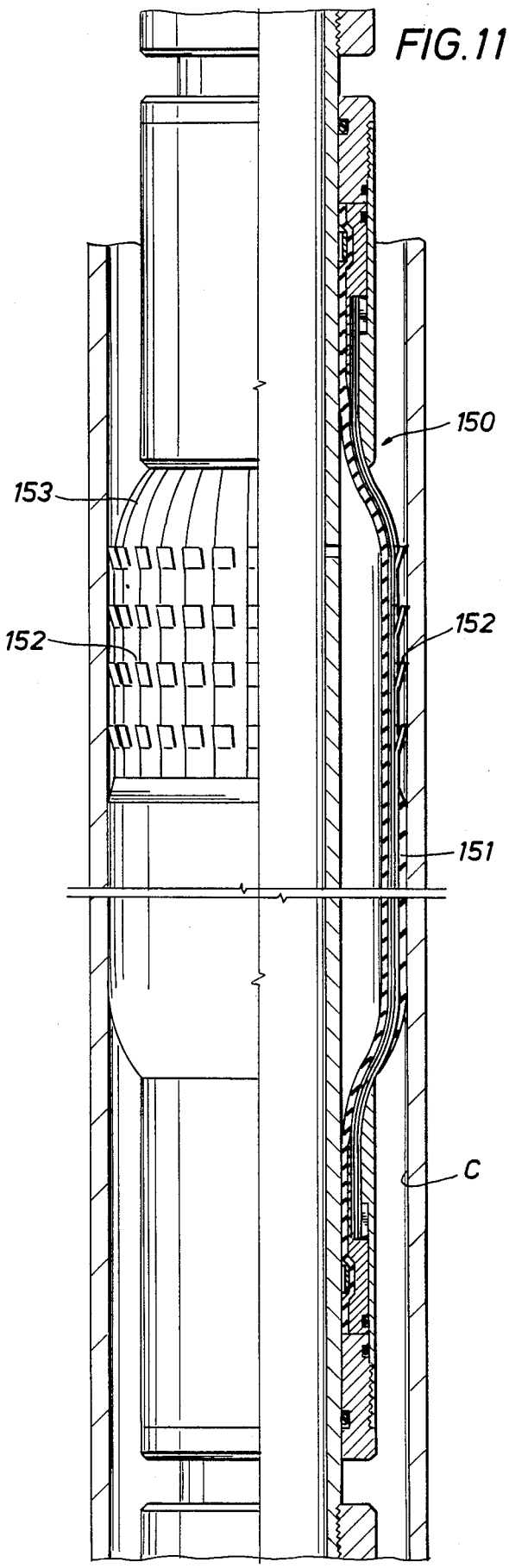
Figure 16:
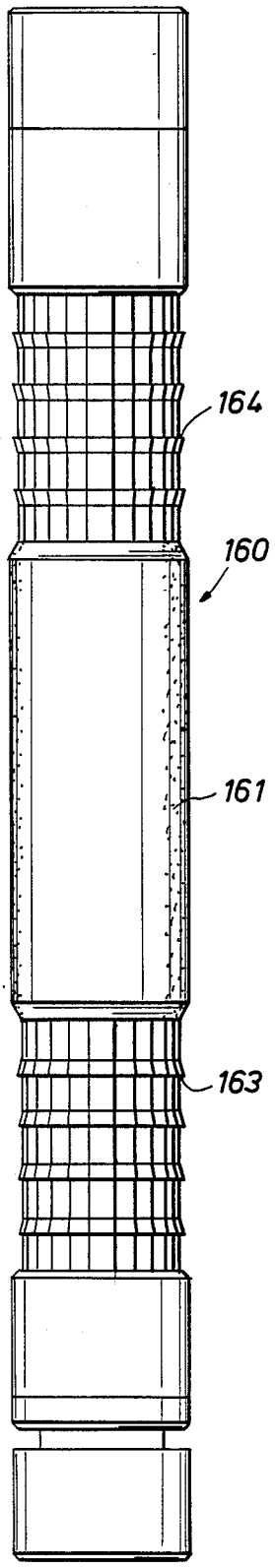
Figure 17:
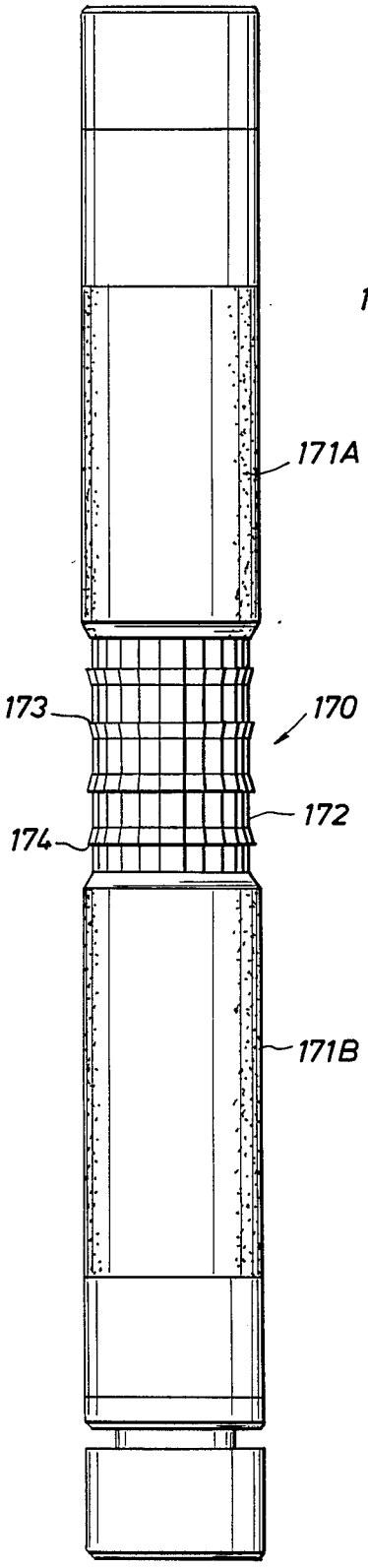
Figure 18:
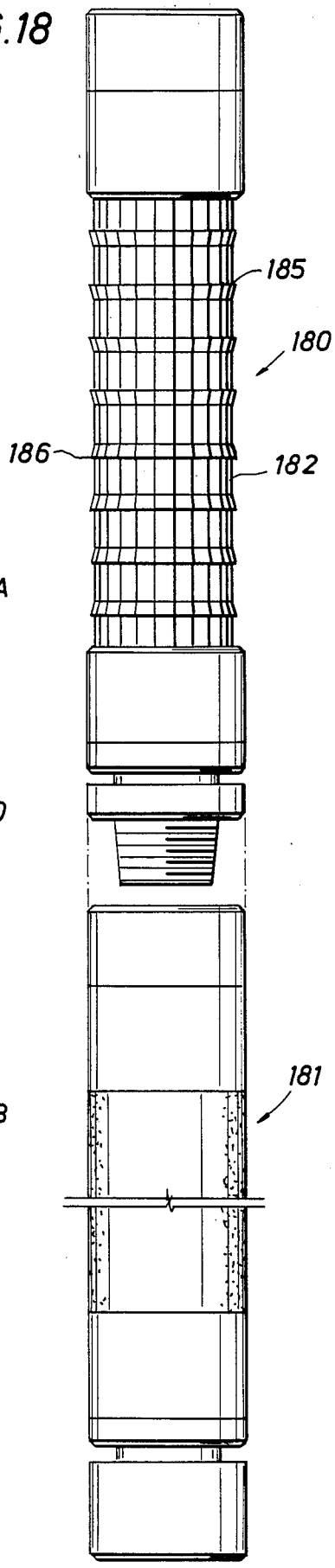
Figure 19:
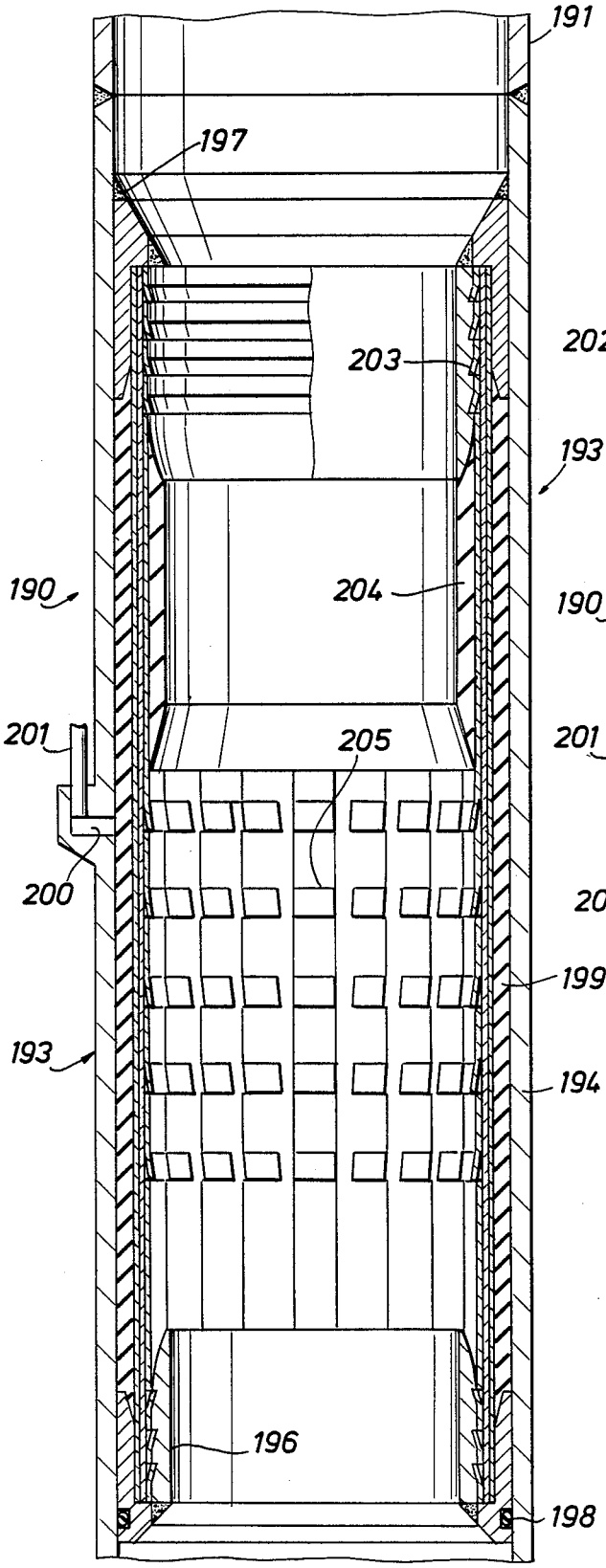
Figure 20:
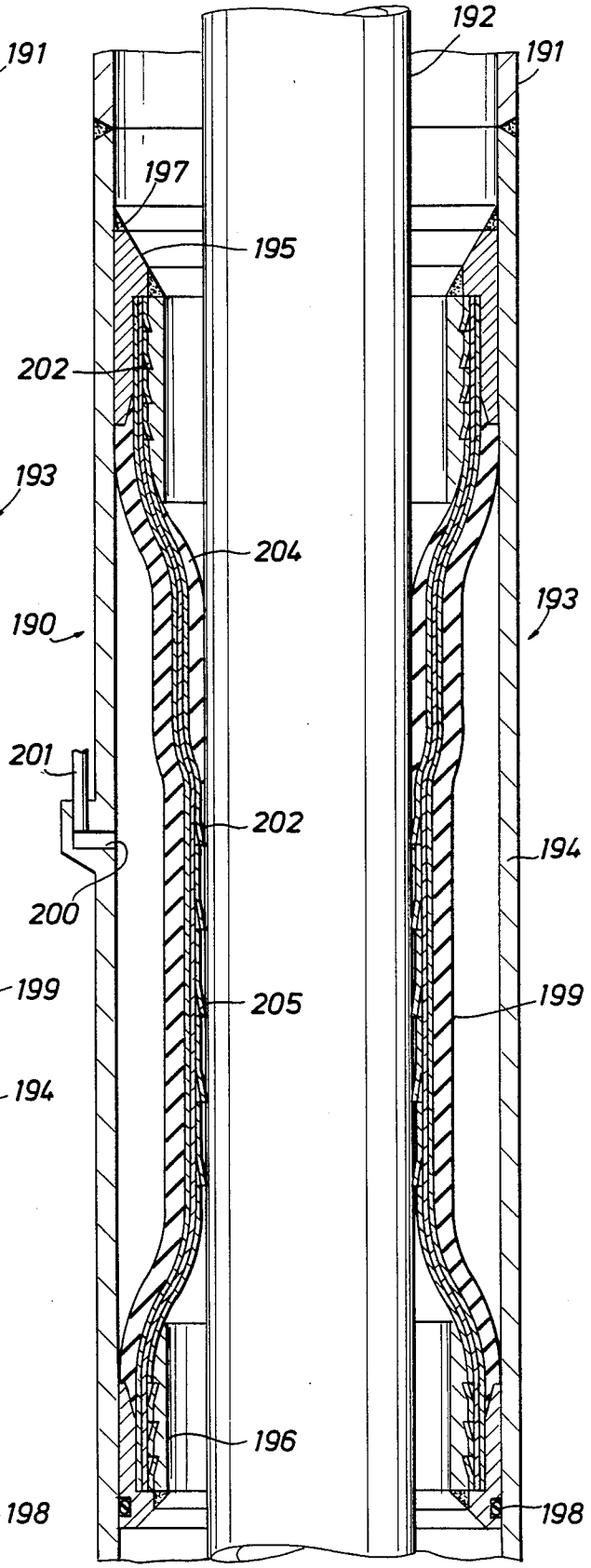

FIGS. 6, 7, and 8 are front, top and end views of the upper end of a reinforcing strip;

FIG. 9 is a side view, partly in vertical section, of the upper end of a well packer constructed in accordance with the second described embodiment of the present invention;

FIG. 10 is a side view, partly in vertical section, and interrupted intermediate its length, of a modified version of the well packer of FIGS. 1 to 8 wherein the outer sleeve is disposed about only the lower portions of the strips and wherein tabs are struck from uncovered portions of the slips for biting into a wall of the well bore;

FIG. 11 is a view similar to FIG. 10, but wherein the inner sleeve, metal strips and outer sleeve have been expanded to cause the outer sleeve to sealably engage a well within the wall bore and the tabs to bite into the wall above the engagement of the outer sleeve;

FIGS. 12–15 show intermediate portions of metal strips having tabs struck therefrom for biting into a wall within the well bore;

FIG. 16 is a side view of a well packer constructed in accordance with a further modified version of the present invention, wherein the outer sleeve is disposed about only the intermediate portions of the metal strips and tabs of the metal strips above and below the outer sleeve are disposed for biting into the wall;

FIG. 17 is a side view of still a further version of a well packer, wherein the outer sleeve surrounds the upper and lower portions of the metal strips and tabs are formed on the intermediate portions of the strips for biting into the wall;

FIG. 18 is a side view of a well anchor constructed in accordance with the present invention, and disposed above but disconnected from a well packer or other well tool adapted to be suspended therefrom;

FIG. 19 is a vertical sectional view of an inwardly inflatable packer installed within the hollow leg of an offshore platform, for packing off about and anchoring to a piling to be driven through the leg; and FIG. 20 is a view of the packer of FIG. 19 upon inflation into packed off and anchored position about the piling.

Figure 1:
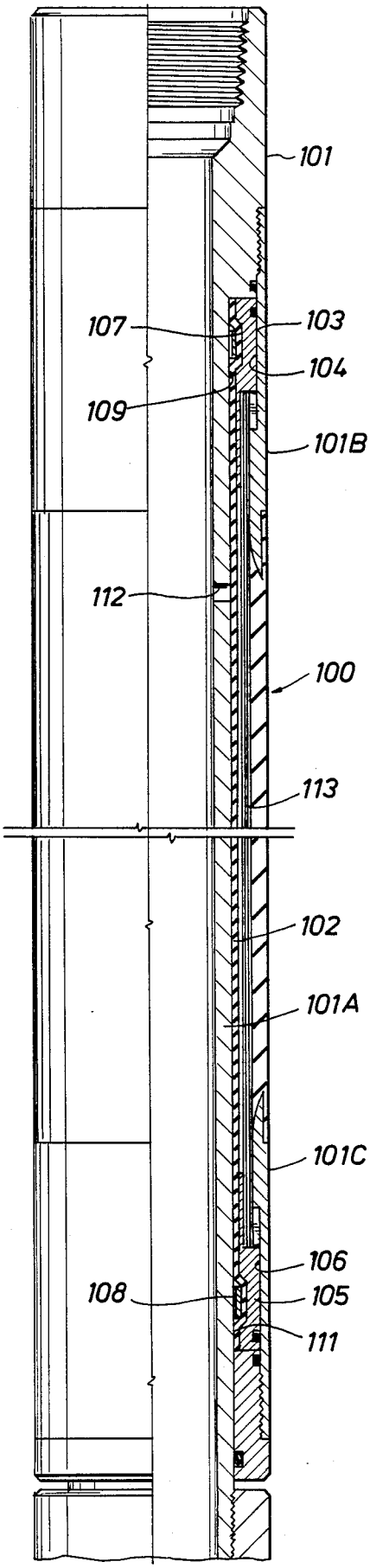
FIG. 1 is a side view, partly in vertical section and interrupted intermediate its upper and lower ends, of a well packer constructed in accordance with the first described embodiment.
Figure 2:
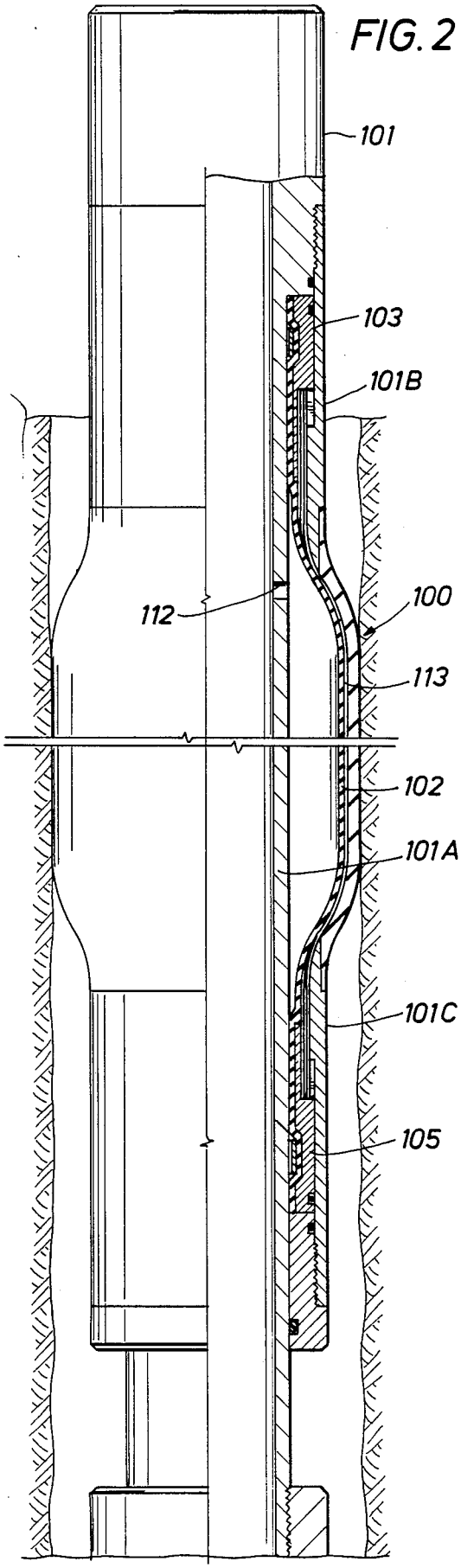
FIG. 2 is a view similar to FIG. 1, but upon inflation of the inner sleeve and thus the reinforcing strips to expand the outer sleeve of elastomeric material into sealing engagement with a wall of the well bore.

With reference now to the details of the above described drawings, the well packer shown in FIGS. 1 and 2, and indicated in its entirety by reference character 100, comprises a mandrel 101 including a tubular section 101A having threads on its upper end for connection to a well string on which it may be lowered or raised, as well as means on its lower end for connection with the lower end of a well string. The mandrel 101 also includes an outer tubular section 101B threadedly connected to the upper end of section 101A and spaced therefrom to form an upper head having an annular recess, as well as outer tubular section 101C having an enlarged lower end sealably slidable over section 101A and spaced therefrom to form a lower head having an annular recess adapted to be moved longitudinally with respect to the upper fixed head.

An inner sleeve 102 of elastomeric material surrounds the tubular section 101A of the mandrel and is anchored at its upper and lower ends to the upper and lower heads. More particularly, the upper end of the sleeve 102 is anchored to a ring 103 received within the annular recess in the upper head, and the lower end of the sleeve 102 is secured to a ring 105 which is received within the annular recess in the lower head. Thus, as best shown in FIG. 3, each of the rings 103 and 105 has a groove 107 about its inner side, and a metal ring 108 is swaged outwardly against the inner side of the ring opposite the groove to hold it tightly within the groove.

The upper and lower ends of the sleeve 102 and the rings 103 and 105 are closely between the inner and outer walls 109 and 110 of an enlarged outer end of each recess, and a seal ring 111 is carried about the outer diameter of each ring for sealably engaging the outer wall 110 of the recess. Thus, fluid under pressure may be introduced through one or more ports 112 formed in tubular section 101A of the mandrel so as to inflate the inner sleeve from the position of FIG. 1 to the position of FIG. 2 and thus raise the lower head upwardly along the mandrel. Fluid pressure is supplied through the running string, or alternatively, through a pipe string lowered into the mandrel section 101A and packed off above and below the port 112.

A plurality of relatively flat strips 113 are arranged about the inner sleeve 102 of elastomeric material with their side edges in overlapping relation and with their opposite ends anchored to the upper and lower heads, the strips being sufficiently flexible to permit their portions intermediate the heads to expand outwardly with the inflation of the inner sleeve 102. Thus, as best shown in FIG. 3, the inner end of the outer confining wall 110 of each of tubular sections 101B and 101C has a reduced diameter to form a shoulder 114 in the recess of the head which faces upwardly in the case of the upper head and downwardly in the case of the lower head. More particularly, each shoulder is spaced from the anchor ring in the recess of the head, and outwardly projecting portions 113A on the outer sides of the adjacent ends of the strips are received within the space with their end edges 113B opposite the shoulder to anchor them to the heads.

More particularly, each anchor ring has a skirt 115 on its inner end which extends between the sleeve 102 adjacent its outer end and the ends of the strips to form an inner confining wall 116 of the recess opposite the reduced diameter portion of the outer confining wall 110. Thus, as best shown in FIGS. 3 and 4, the overlapping side edges of the metal strips extend closely between the confining walls so as to retain the portions 113A of the strips within the enlarged end of the recess intermediate the shoulder 114 and the end of the anchor ring.

The radially outer side edge of the end of each strip is bent at an angle of about 90° to its substantially flat surface to form the portion 113A. Preferably, the inner edge 113B and oppositely facing shoulder 114 extend radially to resist any tendency for portions 113A to be swaged inwardly. More particularly, the bent portion 113A is inclined at an acute angle with respect to the longitudinal and in a direction from its outer side edge from which it is bent toward its radially inner side edge (as shown assembled in FIG. 4). Preferably, and as shown, a notch 116 is formed in the radially outer side edge of the strip so the portion 113A may be bent from a strip having a straight side edge. The end of the strip has, of course, previously been prepared by cutting its side edge along a bias.

Metal spacers 120 are disposed closely between the bent portions of adjacent strips so as to hold them in spaced apart relation and thus determine the extent of overlap between adjacent strips as well as prevent their bent portions 113A from being straightened out. Additionally, the inclination of the bent portions with respect to the longitudinal will cause the force transmitted to the each bent portion to be transmitted to an adjacent strip as the intermediate portions of the strips are flexed outwardly with the inflating inner sleeve. As will also be appreciated, as the intermediate portions of the strip are flexed outwardly, their outer side edges will move circumferentially away from one another. Preferably, the overlap between the strips is such that they will be maintained in overlapping relation even when the packer is inflated.

As previously described, the strips are formed of a relatively rigid, but flexible material, preferably, spring steel.

An outer sleeve 121 of elastomeric material is disposed about the metal strips so as to expand outwardly with them upon inflation of the inner sleeve, and thus sealably engage the wall of the well bore, as shown in FIG. 2. The outer sleeve is preferably molded to the outer sides of the metal strip, and has upper and lower ends which are received within the outer tubular sections of the mandrel at each head.

The alternative embodiment of the well packer shown in part in FIG. 9 comprises a mandrel 130 similar to that of the previously described well packer. Thus, it includes a tubular section 130A adapted to be suspended at its upper end from a pipe string as well as an outer tubular section 130B threadedly connected to the upper end to the section 130A and spaced therefrom to form an upper head having an annular recess, and an outer tubular section (not shown) sealably slidably along and spaced from the lower end of section 130A to form a lower head having a similar annular recess.

As in the case of the first described embodiment of the well packer, a sleeve 132 of elastomeric material is disposed about the intermediate portion of the tubular section 130A of the mandrel and anchored at its upper and lower ends to the upper and lower heads of the mandrel. More particularly, the upper and lower ends of the sleeve may be anchored to the heads in substantially the same manner as the previously described mandrel. Thus, as shown in FIG. 9, the upper end of the sleeve is held tightly within a groove 131 about an anchor ring 133 received in an enlarged outer end of the recess in the head by a metal ring 134 which is swaged outwardly opposite the groove. More particularly, the anchoring ring is held between a shoulder on the upper side of a flange 130C about the inner wall of tubular section 130A and an end wall of the recess, and the anchor ring and upper end of the sleeve are held closely between inner and outer walls of the enlarged end of the recess. Furthermore, a seal ring 135 is carried about the outer diameter of the lock ring 133 for sealably engaging the inner diameter of the tubular section 130B of the mandrel, the lower end of the sleeve is anchored and sealed with respect to the lower, movable head (not shown) in the same manner. Thus, pressure fluid may be applied through a port formed in the tubular section 130A to the inner side of the inner sleeve for inflating it.

As was also true in the previously described well packer, the packer 129 includes substantially flat reinforcing strips 136 which are disposed about the inner sleeve 132 with their side edges in overlapping relation. However, the well packer 129 differs from the previous well packer in the manner in which the opposite ends of the strips are anchored to the upper and lower heads.

More particularly, the anchor ring 133 has a skirt 138 on its lower end which extends beyond the flange 130C in the recess for disposal between the sleeve and the inner side edges of the strips. Thus, the strips have their radially inner and outer side edges confined between the skirt 138 and inner wall of mandrel section 130B beneath flange 130C.

The upper ends of the metal strips have tabs 140 which are struck therefrom and bent outwardly to engage with shoulders 139 on the lower end of grooves 137 formed about the inner diameter of tubular mandrel section 130B upon movement of the ends of the metal strips into the recess between the confining walls. That is, the tabs are formed by L-shaped cuts in the edges of the strips which enable them to flex inwardly as they move past the inner wall of section 130A and then outwardly into the grooves when opposite thereto. In the case of the lower ends of the strips, the tabs (not shown) would of course extend outwardly and upwardly with respect to the sides of the strips to dispose their free edges in position to engage downwardly facing shoulders on the grooves formed in the tubular section of the lower head. More particularly, each of the grooves is formed by a frusto-conically wall which extends downwardly and outwardly in the case of the recess in the upper head and upwardly and outwardly in the case of the recess in the lower head. Thus, as the ends of the metal strips move into the recesses of the heads , the tabs flex inwardly to move past the grooves until fully inserted within the recess, at which time the tabs flex outwardly into the grooves to dispose their free edges opposite the shoulders and thus prevent them from being pulled outwardly as the strips flex outwardly with the inflation of the inner sleeve.

As indicated in FIG. 9, an outer sleeve 141 of elastomeric material is disposed about the metal strips to provide an outer surface for sealing with respect to the wall within the well bore upon inflation of the inflatable element of the packer.

Well packer 150 shown in FIGS. 10 and 11 is similar to the well packer 129 of FIGS. 1 to 5, except that the outer sleeve 151 of elastomeric material is disposed about only the lower portions of the metal strips above the lower head of the mandrel. Thus, the outer sides of a portion of the strips between the upper head and the upper edge of the outer sleeve 151 are not covered so that, upon expansion of the inner sleeve, it is expanded into tight engagement with a wall within the well bore above the sealable engagement of the outer diameter of the outer sleeve 151 therewith. In accordance with one novel aspect of the present invention, the exposed portions of the outer sides of the strips 153 are caused to bite into the wall of the well bore (in this case casing C rather than an open hole as in the case of packer 100) so as to anchor the packer within the well bore. For this purpose, as is shown in FIGS. 10 and 11, tabs 152 are struck from the side edges of the portions of the strips which are not overlapped by an adjacent strip for extension outwardly and upwardly so that they resist upward movement of the packer when expanded into biting engagement with the wall of the well bore.

It will be understood that the spring steel from which the strips are formed will bite into all grades of oilfield pipe as well as an uncased well bore. Furthermore, only the outer ends of the tabs need bite into the wall so as to anchor thereto–i.e., it is not necessary that the flat outer surfaces of the strips engage the wall. Also, if the tabs are found to be too flexible, they may be backed up by small weldments behind them.

Packer 150 also differs from those previously described in that the upper head of the mandrel to which the upper and lower ends of the inner sleeve and strips are anchored is longitudinally slidable with respect to the inner tubular section of the mandrel. Thus, the lower head may instead be fixed thereto, or, alternatively, also slidable longitudinally of the inner tubular section.

The embodiment of the packer shown in FIG. 16, and indicated in its entirety by reference character 160, is similar to that of FIGS. 10 and 11 except that the outer sleeve 161 of elastomeric material is disposed about only a central portion of the strips 163 intermediate the upper and lower heads, thus leaving exposed outer sides of the strips above and below the outer sleeve be sealably engaged with a wall of the well bore. Also, in the case of the packer 160, tabs 162 formed on the lower exposed portions of the strips extend downwardly and outwardly so that, when they bite into the wall of the well bore, they will resist movement of the packer downwardly. Tabs 164 on the upper exposed portions of the strips extend upwardly and outwardly so that combination of tabs on the upper and lower exposed portions of the strips prevents either upward or downward movement of the packer.

The packer shown in FIG. 17, and indicated in its entirety by reference character 170, differs from that of packer 160 of FIG. 16 in that the outer sleeve of elastomeric material is formed in upper and lower sections 171A and 171B disposed about the strips 172 adjacent the upper and lower heads of the packer, but spaced apart at an intermediate portion of the packer to provide an intermediate area of exposed strips. As shown, the exposed portions of the strips have tab portions 173 adjacent the upper sleeve portion 171A which extend upwardly to resist upward movement of the packer, when inflated, as well as tabs 174 adjacent the lower portion of the outer sleeve which extend downwardly to resist downward movement of the packer when inflated.

The tool illustrated in FIG. 18, and indicated in its entirety by reference character 180, is a well anchor constructed in accordance with another embodiment of the invention which is similar to the above-described tools, except that no portion of the outer sides of the strips 182 intermediate the upper and lower heads is covered with an outer sleeve of elastomeric material. Thus, the tool 180 does not seal off the well bore, but instead merely anchors another tool to which it is connected, such as the packer 181 shown in FIG. 18, to the well bore. In this case, the outer sides of the strips are provided with tabs 185 and 186 which face upwardly as well as downwardly, much as in the case of the packer 170, so as to anchor the packer 181 against either upward or downward movement.

Although the ends of the inner elastomeric sleeve and strips of the packer 150 of FIGS. 10 and 11 are shown to be anchored to the mandrel in the manner of the packer 100, it will be understood that they may instead be anchored in the manner of the packer 129 of FIG. 9. In like manner, the ends of the inner sleeve and strips of the packers and well anchor of FIGS. 16 to 18 may be anchored in the manner of either packer 100 or packer 129. In fact, in accordance with certain aspects of the invention, wherein the outer sides of the strips are provided with means for biting into the wall of the well bore, it is contemplated that the ends may be anchored in accordance with more conventional means such as that of the previously mentioned prior patents.

Figure 12:
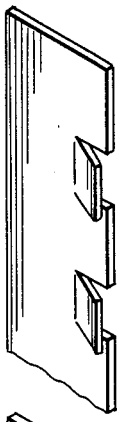
Figure 13:
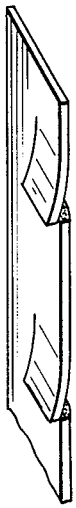
Figure 14:
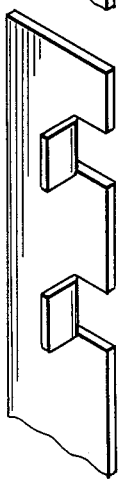
Figure 15:
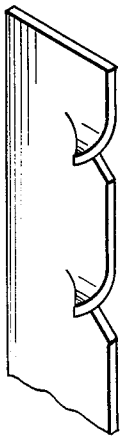

FIGS. 12–15 show portions of reinforcing strips having tabs formed along their intermediate portions in accordance with typical embodiments of the present invention to resist vertical and/or rotational movement of the packer or anchor. In the case of FIG. 12, the tabs are formed by horizontal cuts in the edge of the strip, to permit them to be bent along vertical lines. In FIG. 13, the tabs are formed by a single horizontal cut and bent along horizontal lines, and are similar in this respect to the tabs previously described. FIG. 14 merely illustrates the fact that the tabs may be bent outwardly to an angle of substantially 90° with respect to the flat side of the strip. FIG. 15 illustrates tabs which may be formed by only a single cut, in this case at an angle with respect to the horizontal, to permit the tabs to be bent upwardly.

The packer shown in FIGS. 19 and 20, and indicated in its entirety by reference character 190, differs from those previously described in that it is installed as part of an outer conductor, which may be a leg 191 of an offshore platform, for packing off about the outer wall of an inner conduit, which may be a piling 192 to be driven though the leg. Thus, the packer comprises a mandrel 193 installed as a part of the leg, and an inwardly inflatable element for packing off about the wall of the piling arranged concentrically within the leg. As in the previously described embodiments of the invention, the mandrel 193 includes a tubular section 194 having upper and lower heads 195 and 196, respectively, which are movable relatively longitudinally toward and away from one another. However, in this case, each of the heads is mounted within and thus surrounded by the tubular section 194, the upper head 195 being fixed thereto by means of a weldment 197, and the lower head 196 carrying a seal ring 198 thereabout for sealably slidable within the tubular section 194.

Each head is comprised of inner and outer tubular sections which are radially spaced apart to form annular recesses therebetween having respectively inner and outer confining walls. The inflatable element of the packer includes an outer sleeve 199 which is anchored at its upper and lower ends to the upper and lower heads, and which is adapted to be inwardly inflated by fluid pressure supplied to the space about the outer sleeve through a port 200 and a fluid line 201 leading thereto from a suitable source of pressure fluid.

The inflatable element also includes, as in the other embodiments of the invention, substantially flat, relatively rigid but flexible strips 202 which are anchored at their ends to the upper and lower heads respectively. However, in the case of the packer 190, the strips are arranged concentrically within the outer sleeve 199 so as to be flexed inwardly upon inflation of the outer sleeve. The ends of the strips are anchored to the heads in much the same manner described in connection with the packer of FIG. 9. Thus, the inner confining wall of the recess of each head is provided with grooves 202 having shoulders on one end thereof, and the ends of the strips are provided with flexible tabs 203 whose free ends are adapted to engage with the shoulders as the tabs flex into the grooves upon being inserted into the recesses in the heads. Thus, as in the previously described embodiments of this type of anchoring means, the shoulders in the upper head face upwardly, while those in the lower head face downwardly, and the tabs on the upper ends of the strips are bent outwardly and downwardly, while the tabs on the lower ends of the strips are bent outwardly and upwardly.

The inflatable element of the packer 190 also includes an inner sleeve 204 which is disposed within and covers the portions of the strips beneath the upper head 195 so as to pack off about the piling just beneath the upper head, as illustrated in FIG. 20. However, the remaining portions of the strips intermediate the inner sleeve 204 and the lower head 196 are uncovered, and are provided with outwardly projecting tabs 205 which are adapted to bite into the wall of the piling and thus anchor the packer with respect to the piling. As shown, these tabs are bent downwardly and inwardly, although some or all of them may instead be bent outwardly and upwardly.

It is contemplated that, in use, inflation of the packer into engagement about the piling enables grout to be installed within the annular space between the piling and leg of the platform above the packer so as to anchor the piling within the leg. Obviously, however, similar packers may be used for packing off about the walls of other conduits disposed concentrically within the packer.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An inflatable tool, comprising a mandrel adapted to be arranged concentrically with respect to a cylindrical wall and including a tubular section having upper and lower heads thereabout which are longitudinally movable relatively toward and away from one another, and an inflatable element adapted to be moved into engagement with the wall, said inflatable element including a sleeve of elastomeric material arranged concentrically of the tubular section of the mandrel and anchored at each longitudinal end to the heads, substantially flat, relatively rigid but flexible strips arranged concentrically of the side of the sleeve opposite the tubular section and with their sides in overlapping relation, means anchoring the longitudinal ends of the strips to the heads while leaving their intermediate portions free to move radially toward the wall in response to inflation of the sleeve, said anchoring means comprising means in each head having radially inner and outer walls confining the radially inner and outer side edges of the strips and a shoulder about one wall which faces away from the shoulder about one wall of the other head, a portion which extends from each end of each strip to dispose its longitudinally inner end edge over the shoulder, said portion being inclined at an acute angle with respect to the longitudinal and extending in a direction from one side edge toward its other side edge, and spacers between the portions of adjacent strips.

2. An inflatable tool of the character defined in claim 1, wherein the sleeve surrounds the tubular section of the mandrel for expansion radially outwardly, and the strips are arranged about the sleeve so that their intermediate portions expand radially outwardly toward the cylindrical wall.

3. An inflatable tool of the character defined in claim 2, wherein the shoulder is formed on the outer confining wall of the head, and the portion of each strip extends radially outwardly therefrom to dispose its inner end edge over the shoulder.

4. An inflatable tool of the character defined in claim 3, wherein the inner confining wall in each head is formed on a ring disposed between the end edge of the ends of the strips and a longitudinal end wall of the head, and the end of the sleeve is secured to the radially inner side of the ring to anchor it to the head.

5. An inflatable tool, comprising a mandrel adapted to be arranged concentrically with respect to a cylindrical wall and including a tubular section having upper and lower heads thereabout which are longitudinally movable relatively toward and away from one another, and an inflatable element adapted to be moved into engagement with the wall, said inflatable element including a sleeve of elastomeric material arranged concentrically of the tubular section of the mandrel and anchored at each longitudinal end to the heads, substantially flat, relatively rigid but flexible strips arranged concentrically of the side of the sleeve opposite the tubular section and with their sides in overlapping relation, means anchoring the longitudinal ends of the strips to the heads while leaving their intermediate portions free to move radially toward the wall in response to inflation of the sleeve, said anchoring means comprising means in each head having radially inner and outer walls confining the radially inner and outer side edges of the strips and a groove about one confining wall having a shoulder therein which faces away from the shoulder about the one confining wall of the other head, and a tab on each end of each strip which projects from one side thereof in a direction away from its longitudinal end and which is flexible to permit it to move over said one confining wall and opposite the groove and then spring into the groove to dispose its free longitudinal end opposite the shoulder.

6. An inflatable tool of the character defined in claim 5, wherein the sleeve surrounds the tubular section of the mandrel for expansion radially outwardly, and the strips are arranged about the sleeve so that their intermediate portions expand outwardly toward the cylindrical wall.

7. An inflatable tool of the character defined in claim 6, wherein each groove is formed in the outer confining wall of the head, and the tab is bent outwardly from the radially outer side wall of the strip.

8. An inflatable tool of the character defined in claim 7, wherein a flange is formed on each outer confining wall with one side of the flange facing longitudinal end edges of the strips, the inner confining wall of each head is formed on a ring disposed between the other side of the flange and a longitudinal end wall of the head, and the end of the sleeve is secured to the radially inner side of the ring to anchor it to the head.

9. An inflatable tool of the character defined in claim 5, wherein the sleeve is surrounded by the tubular section of the mandrel, and the strips are arranged within the sleeve so that their intermediate portions contract inwardly toward the cylindrical wall.

10. An inflatable tool of the character defined in claim 9, wherein each groove is formed on the inner confining wall of each head, and the tab is bent inwardly from the inner side wall of the strip.

11. An inflatable tool of the character defined in claim 10, wherein a flange is formed on each inner confining wall of each head, and the end of the inner sleeve is secured to the outer side of the ring to anchor it to the head.

12. A packer, comprising a mandrel adapted to be arranged concentrically with respect to a cylindrical wall and including a tubular section having upper and lower heads thereabout which are longitudinally movable relatively toward and away from one another, and an inflatable element adapted to be moved into engagement with the wall, said inflatable element including a sleeve of elastomeric material arranged concentrically of the tubular section and anchored at each longitudinal end to the heads, substantially flat, relatively rigid but flexible strips arranged concentrically of the side of the sleeve opposite the tubular section and with their sides in overlapping relation, means anchoring the longitudinal ends of the strips to the heads while leaving their longitudinally intermediate portions free to move radially toward the wall in response to inflation of the sleeve, said anchoring means comprising means in each head having radially inner and outer walls confining the radially inner and outer side edges of the strips and a shoulder about one wall which faces away form the shoulder about one wall of the other head, a portion which extends from each end of each strip to dispose its longitudinal inner end edge over the shoulder, said portion being inclined at an acute angle with respect to the longitudinal and extending in a direction from one side edge toward its other side edge, and spacers between the portions of adjacent strips, and another sleeve of elastomeric material arranged concentrically of the sides of at least a portion of the strips opposite the first mentioned sleeve and longitudinally intermediate the heads for sealably engaging the wall when forced radially thereagainst.

13. A well packer of the character defined in claim 12, wherein portions of at least certain of the strips which are not covered by the outer sleeve having tabs struck therefrom for biting engagement with the cylindrical wall so as to anchor the packer with respect thereto.

14. A packer, comprising a mandrel adapted to be arranged concentrically with respect to a cylindrical wall and including a tubular section having upper and lower heads thereabout which are longitudinally movable relatively toward and away from one another, and an inflatable element adapted to be moved into engagement with the wall, said inflatable element including a sleeve of elastomeric material arranged concentrically of the tubular section and anchored to each longitudinal end to the heads, substantially flat, relatively rigid but flexible strips arranged concentrically of the side of the sleeve opposite the tubular section and with their sides in overlapping relation, and means anchoring the longitudinal ends of the strips to the heads while leaving their intermediate portions free to move radially toward the wall in response to inflation of the inner sleeve, said anchoring means comprising means in each head having radially inner and outer walls confining the radially inner and outer side edges of the strips and a groove about one wall having a shoulder therein which faces away from the shoulder about one wall of the other head, and a tab on each end of each strip which projects from one side thereof in a direction away from its longitudinal end, each tab being flexible to permit it to move over said one confining wall and opposite the groove and then spring into the groove to dispose its free longitudinal end opposite the shoulder, and another sleeve of elastomeric material arranged concentrically of the sides of at least a portion of the strips opposite the first mentioned sleeve and intermediate the heads for sealably engaging the cylindrical wall when forced radially thereagainst.

15. A well packer of the character defined in claim 14, wherein portions of at least certain of the strips which are not covered by the outer sleeve having tabs struck therefrom for biting engagement with the cylindrical wall so as to anchor the packer with respect thereto.

16. A packer, comprising a mandrel adapted to be arranged concentrically with respect to a cylindrical wall and including a tubular section having upper and lower heads thereabout which are longitudinally movable relatively toward and away from one another, and an inflatable element adapted to be moved into engagement with the wall of the well bore, said inflatable element including a sleeve of elastomeric material arranged concentrically of the tubular section and anchored at each longitudinal end to the heads, substantially flat, relatively rigid but flexible strips arranged concentrically of the side of the sleeve opposite the tubular section and with their sides in overlapping relation, and means anchoring the longitudinal ends of the strips to the heads while leaving their longitudinally intermediate portions free to move radially toward the wall in response to inflation of the sleeve, and another sleeve of elastomeric material arranged concentrically of the sides of at least a portion of the strips opposite the first mentioned sleeve and longitudinally intermediate the heads for sealably engaging the cylindrical wall when forced radially thereagainst, portions of at least certain of the strips which are not covered by the other sleeve having tabs struck therefrom for biting engagement with the cylindrical wall so as to anchor the packer with respect thereto.

17. A well anchor, comprising a mandrel adapted to be arranged concentrically with respect to a cylindrical wall and including a tubular section having upper and lower heads thereabout which longitudinally movable relatively toward and away from one another, and an inflatable element adapted to be moved into engagement with the wall; said inflatable element including a sleeve of elastomeric material arranged concentrically of the tubular section and anchored at each longitudinal end to the heads, substantially flat, relatively rigid but flexible strips arranged concentrically about the side of the sleeve opposite the tubular section and with their sides in overlapping relation, and means anchoring the longitudinal ends of the strips to the heads while leaving their intermediate portions free to move radially toward the wall in response to inflation of the sleeve, and portions of at least certain of the strips intermediate their ends having tabs struck therefrom for biting engagement with the cylindrical wall of so as to anchor with respect thereto.

18. An anchor of the character defined in claim 17, wherein the tabs are arranged to prevent vertical movement of the anchor.

19. An anchor of the character defined in claim 17, wherein the tabs are arranged to prevent rotational movement of the anchor.

20. An anchor of the character defined in claim 17, wherein the tabs are arranged to prevent vertical and rotational movement of the anchor.

21. An anchor of the character defined in claim 17, wherein the tabs are struck from the side edges of the strips.

22. An anchor of the character defined in claim 17, wherein said anchoring means comprises means in each head having radially inner and outer walls confining the radially inner and outer side edges of the strips and a shoulder about one wall which faces away from the shoulder about one wall of the other head, a portion which extends from each end of each strip to dispose its longitudinal inner end edge over the shoulder, said portion being inclined at an acute angle with respect to the longitudinal and extending in a direction from one side edge toward its other side edge, and spacers between the portions of adjacent strips.

23. An anchor of the character defined in claim 17, wherein said anchoring means comprises means in each head having radially inner and outer walls confining the radially inner and outer side edges of the strips and a groove about one confining wall having a shoulder therein which faces away from the shoulder about the one confining wall of the other head, and a tab on each end of each strip which projects from one side thereof in a direction away from its longitudinal end and which is flexible to permit it to move over said one confining wall and opposite the groove and then spring into the groove to dispose its free longitudinal end opposite the shoulder.

24. An inflatable tool, comprising a mandrel adapted to be arranged concentrically with respect to a cylindrical wall and including a tubular section having upper and lower heads thereabout, and an inflatable element adapted to be moved into engagement with the wall, said inflatable element including a sleeve of elastomeric material arrange concentrically of the tubular section of the mandrel and extending longitudinally from one head to the other, substantially flat, relatively rigid but flexible strips arranged concentrically of the side of the sleeve opposite the tubular section and with their sides in overlapping relation, means anchoring one longitudinal end of each strip to one of the heads while leaving the other longitudinal end free to move longitudinally with respect to the one longitudinal end so that the longitudinally intermediate portions may move radially toward the cylindrical wall in response to inflation of the sleeve, said anchoring means comprising means in the one head having radially inner and outer walls confining the radially inner and outer side edges of the strips and a shoulder about one wall which faces away from the other head, a portion which extends from each end of each one strip to dispose its longitudinal inner end edge over the shoulder, said portion being inclined at an acute angle with respect to the longitudinal and extending in a direction from one side edge toward its other side edge, and spacers between the portions of adjacent strips.

25. An inflatable tool, comprising a mandrel adapted to be arranged concentrically with respect to a cylindrical wall and including a tubular section having upper and lower heads thereabout, and an inflatable element adapted to be moved into engagement with the wall, said inflatable element including a sleeve of elastomeric material arranged concentrically of the tubular section of the mandrel and extending longitudinally from one head to the other, substantially flat, relatively rigid but flexible strips arranged concentrically of the side of the sleeve opposite the tubular section and with their sides in overlapping relation, means anchoring one longitudinal end of each strip to one of the heads while leaving the other longitudinal end free to move longitudinally with respect to the one end so that the longitudinally intermediate portions may move radially toward the wall in response to inflation of the sleeve, said anchoring means comprising means in the one head having radially inner and outer walls confining the radially inner and outer side edges of the strips and a groove about one confining wall having a shoulder therein which faces away from the shoulder about the one confining wall of the other head, and a tab on each end of each strip which projects from one side thereof in a direction away from its longitudinal end and which is flexible to permit it to move over said one confining wall and opposite the groove and then spring into the groove to dispose its free longitudinal end opposite the shoulder.

26. A packer, comprising a mandrel adapted to be arranged concentrically with respect to a cylindrical wall and including a tubular section having upper and lower heads thereabout, and an inflatable element adapted to be moved into engagement with the wall, said inflatable element including a sleeve of elastomeric material arranged concentrically of the tubular section and extending longitudinally from one head to the other, substantially flat, relatively rigid but flexible strips arranged concentrically of the side of the sleeve opposite the tubular section and with their sides in overlapping relation, means anchoring the upper ends of upper portions of the strips to the upper head and anchoring the lower ends of lower portions of the strips to the lower head, said anchoring means comprising means in each head having radially inner and outer walls confining the radially inner and outer side edges of the strips and a shoulder about one wall which faces away from the shoulder about one wall of the other head, a portion which extends from each end of each strip to dispose its longitudinally inner end edge over the shoulder, said portion being inclined at an acute angle with respect to the longitudinal and extending in a direction from one side edge toward its other side edge, and spacers between the portions of adjacent strips, and another sleeve of elastomeric material arranged concentrically of the sides of at least a portion of the strips opposite the first mentioned sleeve and longitudinally intermediate the heads for sealably engaging the cylindrical wall when forced radially thereagainst.

27. A packer, comprising a mandrel adapted to be arranged concentrically with respect to a cylindrical wall and including a tubular section having upper and lower heads thereabout, and an inflatable element adapted to be moved into engagement with the wall, said inflatable element including a sleeve of elastomeric material arranged concentrically of the tubular section and extending longitudinally from one head to the other, substantially flat, relatively rigid but flexible strips arranged concentrically of the side of the sleeve opposite the tubular section and with their sides in overlapping relation, and means anchoring the upper ends of the upper portions of strips to the upper head, and anchoring the lower ends of lower portions of the strips to the lower head, said anchoring means comprising means in each head having radially inner and outer walls confining the radially inner and outer side edges of the strips and a groove about one confining wall having a shoulder therein which faces away from the shoulder about the one confining wall of the other head, and a tab on each end of each strip which project from one side thereof in a direction away from its end, each tab being flexible to permit it to move over said one wall and opposite the groove and then spring into the groove to dispose its free longitudinal end opposite the shoulder, and another sleeve of elastomeric material arranged concentrically of the sides of at least a portion of the strips opposite the first mentioned sleeve and longitudinally intermediate the heads for sealably engaging the cylindrical wall when forced radially thereagainst.

* * * * *